United States Patent [19]

Nakazawa et al.

[11] 4,442,951

[45] Apr. 17, 1984

[54] HERMETICALLY SEALED CONTAINER

[75] Inventors: Hiroshi Nakazawa, Funabashi; Makoto Kuji, Saitama, both of Japan

[73] Assignee: Toho Sheet Frame Co., Ltd., Tokyo, Japan

[21] Appl. No.: 457,571

[22] Filed: Jan. 13, 1983

[30] Foreign Application Priority Data

Aug. 18, 1982 [JP] Japan ..... 57-124012[U]

[51] Int. Cl.[3] ..... B65D 45/32

[52] U.S. Cl. ..... 220/319; 220/320; 220/367; 220/378

[58] Field of Search ..... 220/319, 320, 367, 378

[56] References Cited

U.S. PATENT DOCUMENTS 4,344,546 8/1982 Dry ..... 220/319

4,347,947 9/1982 Hammes ..... 220/378

*Primary Examiner*—George T. Hall

*Attorney, Agent, or Firm*—Wegner & Bretschneider

[57] ABSTRACT

A hermetically sealed container with an openable top lid, capable of completely maintaining the hermetically sealed pressure state over a prolonged period, enabling easy release from the pressurized or vacuum state in the container, allowing pressure measurement in the container during storage, and adapted for repetitive use. In this container, the concave surface of lid has corrugated recesses and is provided in the center with a valve for pressure releasing and pressure testing, of which upper end is positioned not exceeding a plane containing the upper rim of the lid.

20 Claims, 11 Drawing Figures

HERMETICALLY SEALED CONTAINER

BACKGROUND OF THE INVENTION

1. Field of the Invention

For the purpose of storage under an elevated or reduced pressure there has been known no large container, but only small containers for food storage commonly known as canned food. Containers with openable top lid are generally known to be unable to provide sufficient pressure resistance, so that containers with sealed small apertures for particular purposes requiring pressure resistance. Such containers generally have very small apertures and are therefore extremely inconvenient for filling and taking out of the content unless it is liquid or powder. Also in such containers the seal has to be destructed for opening the container.

In the field of food industry there are not yet used satisfactory large containers, although the demand for such large containers was pointed out years ago in relation to the change in the food distribution channels and to the introduction of larger transportation vehicles.

2. Description of the Prior Art

Among recent food distribution containers there are known so-called retort food containers of a capacity in the order of 10 liters, which are used both for the food processing and for the food transportation, and which are provided with corrugated shapes on the bottom in order to cope with the deformation by a reduced pressure resulting from vapor condensation induced by a fact that the container is sealed immediately after the content is processed. Such containers, however, cannot be used repeatedly since the lid has to be forced open. There are also known improved containers with fitted lids, but such containers are still associated with a difficulty in filling and taking out of the content. Moreover such retort food containers do not maintain a constant reduced pressure therein and the food is recommended for consumption within a determined period after processing, so that such containers do not have a function of periodic check of the internal reduced pressure.

In this manner a container for prolonged storage which is provided with a valve for pressure release and pressure inspection and is repetitively usable, as aimed at by the present invention, has never been known in the prior art.

SUMMARY OF THE INVENTION

The object of the present invention is to provide a novel hermetically sealed container for storage under a reduced or elevated pressure, which is completely freed from the aforementioned drawbacks and which allows hermetic sealing during storage and easy inspection of the pressure state. The storage under a reduced or elevated pressure as used herein shall include not only the storage in vacuum or with a substituted gas but also the storage for example for foods in an oxygen-free state in the presence of a free-oxygen absorber and the food storage with a heat treatment such as retort processing or boiling, or in frozen state.

According to the present invention, there is provided a hermetically sealed container with an openable top lid, comprising a container body, a top lid, binding member for mutually engaging the body and the lid, wherein said lid is recessed toward the center thereof and is provided at said center with a valve for pressure releasing, filling and pressure measuring the upper end of said valve being positioned not exceeding a plane containing the upper rim of the top lid.

DESCRIPTION OF THE PREFERRED EMBODIMENTS

Now the present invention will be clarified in detail by an embodiment shown in the attached drawings.

A container body 1 is usually provided, on the lateral wall thereof, with peripheral swedges or reinforcing corrugations, of which number and distribution are determined by the calculation of mechanical strength, according to the material and the thickness thereof constituting said container body.

Figure 2:
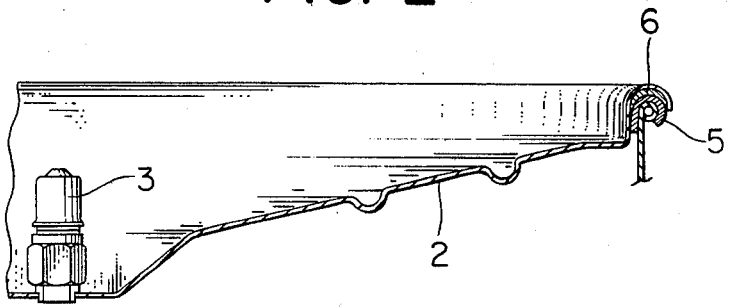
FIG. 2 is a partial cross-sectional view of a lid therefor.
Figure 3:
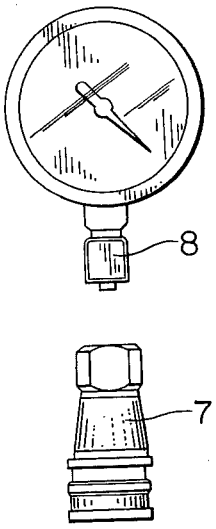
FIG. 3 is an external view of a socket 7 connectable to a valve 3 and a gauge 8 to be coupled with said socket.

A top lid 2 is provided with a rim portion engaging with a chime portion at the uppermost part of the container body, and is recessed toward the center in order to withstand the pressure inside the container, wherein the concave surface constituting said recess is likewise provided with concentric or radial ribs of a number required in consideration of the mechanical strength. At the center of the lid 2 there is provided a valve 3, which is normally closed, is capable of withstanding a determined pressure in the container and is opened when required for reducing, elevating or inspecting the internal pressure. The upper end of said valve 3 is so positioned as not to exceed a plane containing the upper rim of the lid 2, thereby enabling vertical stacking of the containers. The valve structure is not critical, but is preferably of a type composed of a combination of a plug and a socket as shown in FIGS. 2 and 3 wherein the plug is opened or closed respectively when the socket 7 is mounted or detached, since, in such type, there may be employed two sockets respectively for releasing the pressure and for measuring the internal pressure in combination with a gauge 8. Such a valve as composed of a socket and a plug is available from Nitto Kohki Co., Ltd., Tokyo, Japan, as Coupler, Type SP-V. An internal automatic valve mechanism thereof may be employed an ultra-tight closing which withstands vacuum evacuation as low as $10^{-3}$ mmHg.

In such a constitution, a pressure holding means including in a plug, such as ball lock system, is released to let gas pass through when the socket is attached thereto.

Figure 1:
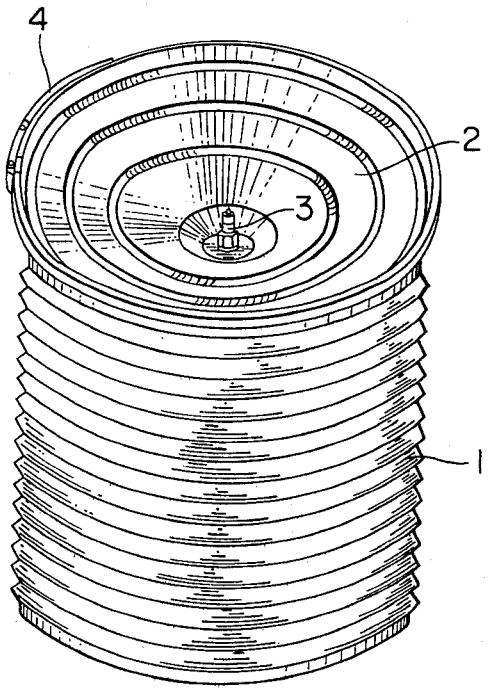
FIG. 1 is an external view of a container embodying the present invention.

Packgings 5, 6 for sealing and a lid fixing band 4 are important members for hermetic sealing but are not limited to the structures shown in FIGS. 1 and 2. As an example said fixing band may be replaced plural clipper clamps positioned regularly along the periphery of the lid.

Figure 4:
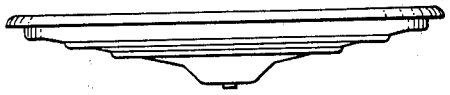
FIG. 4 is a side view of the lid.
Figure 5:
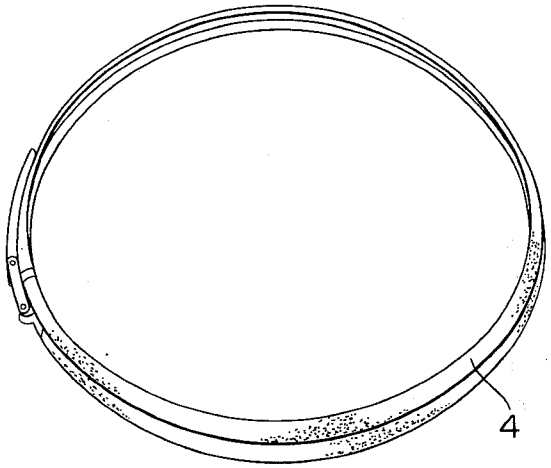
FIG. 5 is a perspective view of a binding member 4.
Figure 6:
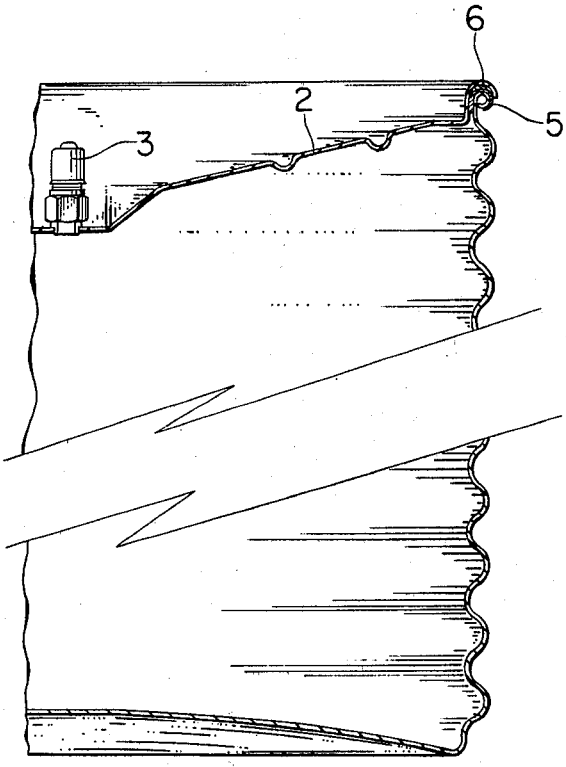
FIG. 6 is a partial cross-sectional view of said container in a state in which a body 1 and a lid 2 are mutually assembled.
Figure 7:
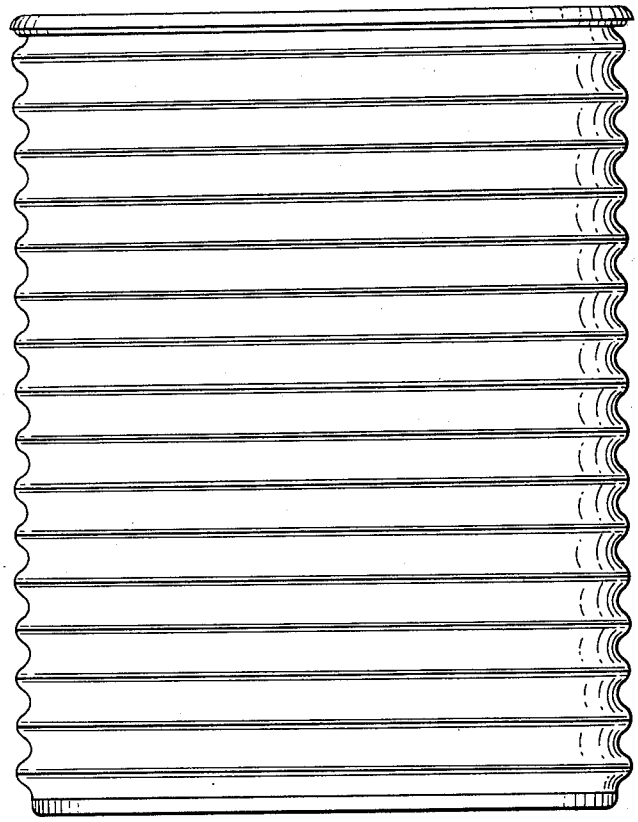
FIG. 7 is a lateral view of the body.

FIG. 4 shows the lateral view of said lid, while FIG. 5 shows an example of the lid fixing band 4. FIG. 6 shows, in a partial cross-sectional view, a state in which the container body 1 and the lid 2 respectively provided with packings 5, 6 are mutually fitted. In this state said container body and the lid are bound together by the lid fixing band 4 to achieve hermetic sealing. Also FIG. 7 shows the lateral external view of the container body 1.

Figure 8:
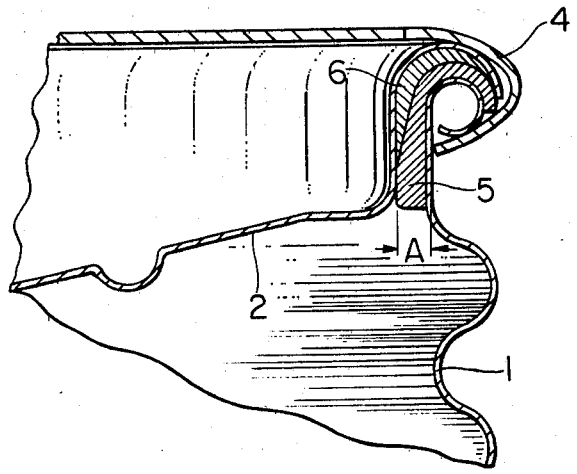
FIG. 8 is a cross-sectional view showing the details of a packing.

According to the present invention, as detailed shown in FIG. 8, it is found that the stability of hermetic sealing can be improved by the use of two-layered flexible structure for the packings 5 and 6. For example the container constructed according to the present invention can satisfactorily maintain a gauge suction pressure of −350 mmHg or even larger, and can further provide satisfactory results down to the destruction pressure of −400 mmHg.

Figure 9:
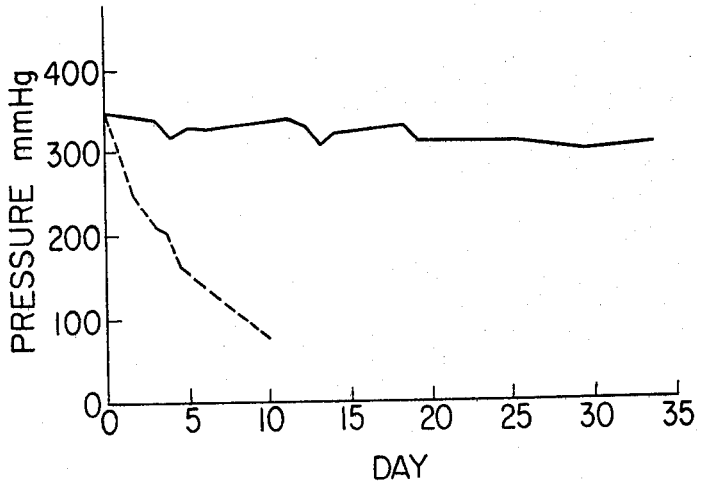
FIG. 9 is a chart showing the state of preservation of the content in the contianer of the present invention.
Figure 10A:
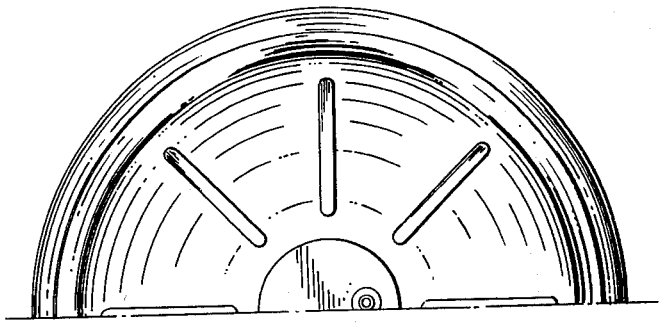
FIG. 10 is a view of an example of the lid with radial corrugations.
Figure 10B:
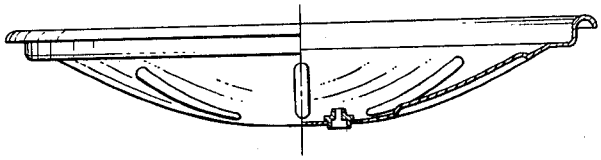

FIG. 9 is a chart showing the result of a depression test with the packings shown in FIG. 8, which was conducted with a distance A of 5 mm shown in FIG. 8. The packings were composed of styrene-butadiene synthetic rubber. A broken line in FIG. 9 shows the result obtained on a conventional drum canister with a prior known single packing of the same material. As can be seen from this chart, the container of the present invention maintained a depression of ca. 350 mmHg almost constantly over 33 days or 792 hours, while in the conventional container the depression decreased to ca. 70 mmHg after 10 days (240 hours).

The packing in the present invention is composed of at least two elements 5, 6 which are respectively adhered to the container body 1 and the top lid and which constitute a hermetic seal by mutual contact. Although it is quite difficult to achieve satisfactory hermetic sealing by a mere contact between a metallic object and a packing, but this problem can be easily resolved by forming a firm adhesion therebetween for example with an adhesive material. Consequently, by tightening the fixing band 7, the packings are brought into intimate mutual contact to ensure secure hermetic sealing that has not been expected in the prior art. In case the metallic body cannot satisfactorily adhered to the packing, it is also possible to insert another packing between said body and packing.

Said packings composed of a same material can provide satisfactory results as indicated in the test, but a further improved result can be obtained if the packing on the container body is made harder than that on the top lid.

The packings employed in the present invention may be composed of any flexible, elastic air-tight material. In case of porous rubber, it should be of closed pores. According to the experiments of the present invention, a satisfactory result can be obtained by a combination of a packing composed of a synthetic rubber sheet on the container body and a packing composed of a porous synthetic rubber sheet on the top lid. Also an even better result can be attained by the use, on the top lid, of so-called hollow packing containing a single closed pore therein for said porous synthetic rubber sheet.

In the foregoing explanation the packing is divided into at least two parts, but it is also possible to compose each part of two or more materials or to insert a third packing and even a fourth packing in order to improve the contact between said two parts.

The size of the container of the present invention can be arbitrarily selected from a small container comparable to so-called pail to a large container comparable to drum canisters. There may be employed any material for said container as long as it can provide a sufficient mechanical strength without causing deterioration of the content during storage, but the use of a stainless steel is preferable for foods in consideration of the possibility of repeated use and of prolonged storage.

The container of the present invention is particularly suitable, because of the extraordinarily improved pressure resistance, for the storage in an oxygen-free atmosphere which has become common for food preservation. As an example, a case containing a suitable amount of free-oxygen absorber is mounted under the lid 2 constituting a part of the present invention, and said lid is fixed with the band to the container after it is filled with the food. The container are usually stored in vertical stacks, and can be used for storing meats, cerials, fishes etc. During the storage the internal pressure is measured with the pressure gauge 8 mounted on the socket 7, thereby confirming the state of the stored foods.

In the foregoing explanation, the container of the present invention has been explained as a container for a reduced pressure, but it is naturally usable also for storage under an elevated pressure.

In the use for food storage, the corners of the bottom are preferably formed as curves and the corrugations on the lateral face should be likewise formed in order to facilitate washing at the repeated use.

What is claimed is:

1. A hermetically sealed container with an openable top lid, comprising:

a container body (1);

a top lid (2);

a binding member (4) for mutually binding said container body and said top lid;

packings (5)(6) for sealing respectively mounted on said container body and said top lid;

wherein said top lid (2) is recessed toward the center thereof and is provided at said center with a valve for pressure releasing, filling and pressure measuring, the upper end of said valve being positioned not exceeding a plane containing the upper rim of the top lid.

2. A hermetically sealed container according to claim 1, wherein said valve (3) is composed of a plug mounted on the upper face of the top lid and of a detachable socket for opening said valve or for measuring the internal pressure.

3. A hermetically sealed container according to claim 1, wherein said binding member (4) comprises a band fixing the periphery of the top lid.

4. A hermetically sealed container according to claim 2, wherein said binding member (4) comprises a band fixing the periphery of the top lid.

5. A hermetically sealed container according to claim 1, wherein said top lid and said container body are composed of a metal or a synthetic resin.

6. A hermetically sealed container according to claim 2, wherein said top lid and said container body are composed of a metal or a synthetic resin.

7. A hermetically sealed container according to claim 1, wherein said packings (5) (6) are provided as flexible members divided at least into two parts in a gap between a suspending portion of the top lid (2) and a vertical portion or a curled portion of the container body (1), and said at least two parts are respectively adhered to the top lid (2) and to the container body (1).

8. A hermetically sealed container according to claim 7, wherein the packings (5) (6) adhered to the container body (1) and to the top lid (2) are not made of a same material but the packing adhered to the container body is harder than that adhered to the top lid.

9. A hermetically sealed container according to claim 2, wherein said packings (5) (6) are provided as flexible members divided at least into two parts in a gap between a suspending portion of the top lid (2) and a vertical portion or a curled portion of the container body (1), and said at least two parts are respectively adhered to the top lid (2) and to the container body (1).

10. A hermetically sealed container according to claim 9, wherein the packings (5)(6) adhered to the container body (1) and to the top lid (2) are not made of a same material but the packing adhered to the container body is harder than that adhered to the top lid.

11. A hermetically sealed container according to claim 3, wherein said packings (5) (6) are provided as flexible members divided at least into two parts in a gap between a suspending portion of the top lid (2) and a vertical portion or a curled portion of the container body (1), and said at least two parts are respectively adhered to the top lid (2) and to the container body (1).

12. A hermetically sealed container according to claim 11, wherein the packings (5) (6) adhered to the container body (1) and to the top lid (2) are not made of a same material but the packing adhered to the container body is harder than that adhered to the top lid.

13. A hermetically sealed container according to claim 1, wherein the container is used for storing food stuff under oxygen-free condition.

14. A hermetically sealed container according to claim 2, wherein the container is used for storing food stuff under oxygen-free condition.

15. A hermetically sealed container according to claim 7, wherein the container is used for storing food stuff under oxygen-free condition.

16. A hermetically sealed container according to claim 8, wherein the container is used for storing food stuff under oxygen-free condition.

17. A hermetically sealed container according to claim 9, wherein the container is used for storing food stuff under oxygen-free condition.

18. A hermetically sealed container according to claim 10, wherein the container is used for storing food stuff under oxygen-free condition.

19. A hermetically sealed container according to claim 11, wherein the container is used for storing food stuff under oxygen-free condition.

20. A hermetically sealed container according to claim 12, wherein the container is used for storing food stuff under oxygen-free condition.

* * * * *